United States Patent [19]

Hudspeth et al.

[11] Patent Number: 4,533,883

[45] Date of Patent: Aug. 6, 1985

[54] COAXIAL TRANSMISSION LINE CROSSING

[75] Inventors: Thomas Hudspeth, Malibu; Harmon H. Keeling, Lake Isabella, both of Calif.

[73] Assignee: Hughes Aircraft Company, El Segundo, Calif.

[21] Appl. No.: 468,827

[22] Filed: Feb. 23, 1983

[51] Int. Cl.[3] ..... H01P 3/06

[52] U.S. Cl. ..... 333/1; 333/245; 333/35

[58] Field of Search ..... 333/245, 244, 243, 1, 333/35, 236; 174/32, 35, 36, 70 C, 71 R, 71 C, 95, 97, 103, 104, 113, 113 AS, 117 R, 117 AS

[56] References Cited

U.S. PATENT DOCUMENTS

| | | | |
|---|---|---|---|
| 3,104,363 | 9/1963 | Butler | 333/246 |
| 3,573,665 | 4/1971 | Knerr . | |
| 4,119,931 | 10/1978 | Hudspeth et al. | 333/111 X |

FOREIGN PATENT DOCUMENTS

| | | |
|---|---|---|
| 1152164 | 2/1967 | Fed. Rep. of Germany . |
| 2226419 | 5/1972 | Fed. Rep. of Germany . |
| 1275378 | 9/1961 | France . |
| 2395618 | 1/1979 | France . |

OTHER PUBLICATIONS

R. W. deGrasse, "Low-Loss Gyromagnetic Coupling Through Single Crystal Garnets", *Journal of Applied Physics*, vol. 30, No. 4, Apr. 1959, pp. 1555-1565.

*Primary Examiner*—Eugene R. LaRoche
*Assistant Examiner*—Benny T. Lee
*Attorney, Agent, or Firm*—W. J. Benman, Jr.; A. W. Karambelas

[57] ABSTRACT

A crossover for a microwave circuit constructed within a plate includes intersecting square-shaped coaxial transmission lines, each of which is formed by machining channels within the plate, with square-shaped central members disposed along the axes of the channels and insulated from the side walls thereof. The plate is made of an electrically conducting material to provide for the structure of a coaxial line of which the members thereof have a rectangular, preferably square-shaped, cross-section. At the intersection of two of the transmission lines, a septum is placed, the septum being parallel to the plane of the plate. The septum is located halfway between the top and the bottom portions of the channels. An inner, or central, conductor segment of reduced cross-section is slung beneath the termini of rod-shaped members in one line so as to pass beneath the septum and to provide for the structure of a coaxial transmission line beneath the septum. A corresponding conductor segment is located above the septum and disposed on termini of the central conductor members of the other one of the intersecting transmission lines. A cover encloses the channels of the plate. The crossover segment of the second transmission line passes between the cover and the septum to provide the structure of a coaxial line between the cover and the septum. Matching structures in the form of a miter at the end of each center conductor reduces reflection at the junction of the segment at the septum with the balance of the transmission line. The foregoing segments are approximately one-quarter wavelength of the microwave frequency.

9 Claims, 2 Drawing Figures

COAXIAL TRANSMISSION LINE CROSSING

BACKGROUND OF THE INVENTION

This invention relates to coaxial transmission lines and, more particularly, to a set of transmission lines having conductors which are of rectangular cross-sections crossing over each other within the confines of a planar plate from which the transmission lines are milled out.

Cross-reference is hereby made to three copending applications pertaining to microwave systems assigned to the same assignee; "Square Conductor Coaxial Coupler" invented by T. Hudspeth, R. V. Basil and H. H. Keeling, Ser. No. 468,826, filed on Feb. 23, 1983; "Ferrite Modulator Assembly For Beacon Tracking System" invented by T. Hudspeth, H. S. Rosen and F. Steinberg, Ser. No. 469,870, filed on Feb. 25, 1983; and "Coaxial Line To Waveguide Adapter" invented by T. Hudspeth and H. H. Keeling, Ser. No. 468,825, filed on Feb. 23, 1983. These applications are hereby incorporated by reference in their entirety.

Coaxial transmission lines are utilized for the transmission of microwave energy. The lines are particularly useful in that they support a TEM (Transverse Electromagnetic) wave over a wide bandwidth. A particular use of transmission lines, in general, is found in the construction of satellites which orbit the earth to provide communications between stations on the earth's surface. Such satellites carry antennas along with receiving and transmitting equipment coupled to the antennas for the relaying of messages transmitted between the earth stations via the satellite.

In order to insure that the satellite antennas are accurately pointed toward the earth stations for the receiving and transmitting of the signals between the stations, an antenna connects with a monopulse feed structure which provides error signals in two coordinates, azimuth and elevation. These error signals are utilized by control circuitry to accurately orient the antenna in a desired direction. The antenna may be physically moved by such control circuitry or, alternatively, in the case of a phased-array antenna, may be electronically steered by the application of phase-shift commands to the phase shifters of the antenna system. In the case of radar systems which also employ a monopulse feed, the control circuitry has utilized both coaxial cable and waveguide for the transmission and combining of the microwave signals of the antenna for the development and processing of the azimuth and elevation drive signals.

However, in the case of a satellite, it is essential to fabricate the microwave circuits in a format that insures a high degree of reliability, and also provides for a relatively small physical size and weight for installation in the satellite. A particular form of microwave circuit structure that is useful in the construction of satellites has the form of a planar plate of a soft, light weight, electrically-conducting metal such as aluminum. The aluminum is readily machined to provide channels which serve as the microwave transmission lines.

With respect to the fabrication of coaxial transmission lines, it is noted that the channels are of a rectangular, preferably square, cross section, the walls thereof serving as the outer walls of a coaxial transmission line. The inner conductor of the coaxial transmission line is fabricated of the same metal, preferably, and is formed with a corresponding rectangular cross-section. The resulting structure is, thus, a square coaxial transmission line. The transmission line is completed by the placing of a cover plate above the base plate in which the channels have been machined, the cover forming the fourth wall of the outer conductor of the square coaxial transmission line.

Such a transmission line can be accurately fabricated in that the outer conductors are formed by a milling operation and that all critical dimensions of the inner conductor can also be attained by a milling operation. Suitable dielectric spacers positioned between the inner and outer conductor support the inner conductor at its proper location relative to the outer conductor of the transmission line.

A problem arises in such a mode of construction in that, in the case of a complex microwave circuit, such as a circuit including hybrid couplers, power dividers and combiners, it may be necessary for one transmission line to cross over a second transmission line without any coupling of the microwave energy between the two lines. Such a crossover greatly facilitates the interconnection of the various components of the circuit since, without such a crossover, it may be necessary to reroute the transmission lines and to rearrange components of the circuit so that all the components and all the transmission lines can be accommodated within the structure of the planar plate. However, no such transmission line crossing has been available heretofore.

SUMMARY OF THE INVENTION

The foregoing problem is overcome, and other advantages are provided, by a transmission line crossing for coaxial lines which incorporates the invention and is ideally suited for the construction of the square coaxial transmission lines within the confines of a planar plate. The crossing is constructed by cutting out a section of the inner conductor in each of two transmission lines at the point where they are to cross. A section of inner conductor of reduced thickness is suspended between the cut ends of the inner conductor of one of the transmission lines. A similar section of inner conductor of reduced thickness is supported above the ends of the cut inner conductor of the second of the two lines. Thus, the two sections of thin inner conductor are able to cross over each other in spaced apart relation. A septum, in the form of a thin plate of electrically conducting material such as aluminum, is disposed between the two thin sections of inner conductor, at the site of the crossover, and is oriented in a plane parallel to the plane of the plate containing the transmission lines. The septum serves as a shield to prevent the cross coupling of microwave signals between the two lines.

With respect to the lower line at the point of the crossover, the septum serves as an upper wall of a coaxial transmission line at the site of the crossover. With respect to the upper line at the site of the crossover, the cover plate serves as the upper wall of the coaxial line while the septum serves as the lower wall of the coaxial line. With both of the transmission lines, the cut ends of the inner conductors are mitered to provide for an impedance match over the band of frequencies of interest. The impedance of the section of the lower transmission line, and of the section of the upper transmission line, is selected by choice of the thickness of the inner conductor and the spacing between the inner and the outer conductors at the point of the crossover.

BRIEF DESCRIPTION OF THE DRAWING

The foregoing aspects and other features of the invention are explained in the following description taken in connection with the accompanying drawing wherein.

DETAILED DESCRIPTION

Figure 1:
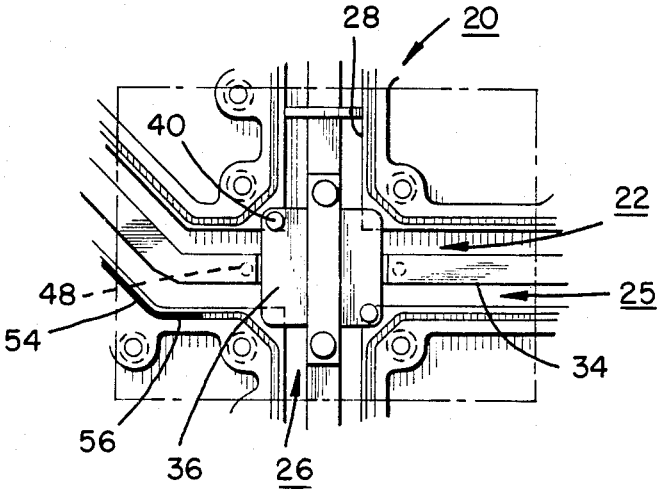
FIG. 1 is a plan view of the microwave structure of the invention at the point of the crossover of two square coaxial transmission lines, the cover plate having been removed in FIG. 1 to disclose the detail of the crossover.
Figure 2:
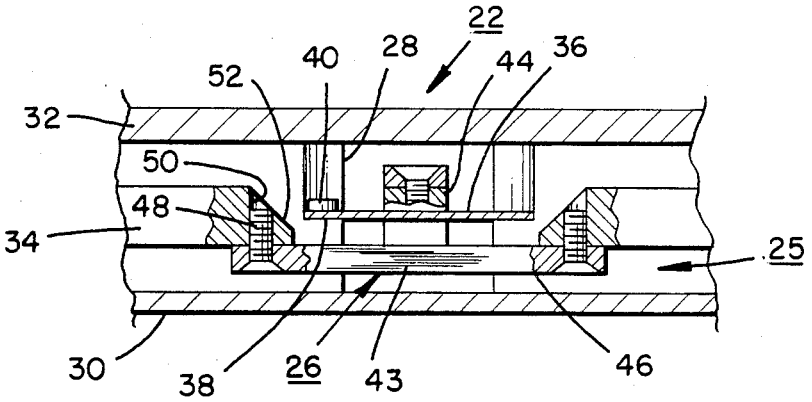
FIG. 2 is a sectional view taken along the line 2—2 through a mid-portion of the cross over of FIG. 1.

With reference to FIGS. 1 and 2, there is shown a portion of a microwave circuit 20, the portion being structured as a crossover 22 of two square coaxial transmission lines 25 and 26. Each of the transmission lines 25–26 is formed by milling out a channel 28 in a base plate 30, the channel 28 being closed off by a cover plate 32 (partially shown in FIG. 2).

The base plate 30 and the cover plate 32 are fabricated of a relatively soft, light-weight, electrically conducting material such as aluminum. The choice of a light weight material is preferred for use in satellites as it reduces the weight of the electronics equipment. The use of a soft metal facilitates the milling operation and the fabrication of the channel 28. The side walls, the top wall and the bottom wall of each channel 28 serve as outer conductors of the coaxial lines 25–26. The inner or central conductors are formed of rods 34 having a rectangular or square shaped cross-section. In the preferred embodiment of the invention, both the outer conductor and the inner conductor of each of the lines 25–26 are square shaped. The rods 34 are readily supported within the channel 28 by means of dielectric spacers (not shown). The channel 28 of the line 25 meets the channel 28 of the line 26 at the crossover 22.

At the crossover 22, a septum 36 is fabricated as a relatively thin plate of square shape which is supported at its corners by shelves 38 machined at the corners of the intersections of the channels 28. The septum 36 is secured to the shelf 38 by screws 40. Both the septum 36 and the rod 34 are fabricated, preferably, of the same material as the base plate 30. The septum 36 lies in a plane parallel to the plane of the plate 30. The location of the septum 36 is mid-way between the bottom and the top of the channels 28.

The transmission line 25 communicates through the crossover 22 by means of an underpass 43. The transmission line 26 communicates through the crossover 22 by means of an overpass 44. The underpass 43 and the overpass 44 each comprise a bar 46 having a width equal to that of a rod 34 and a thickness approximately one-third the thickness of a rod 34. The bar 46 of the underpass 43 passes under the septum 36 and is secured to the ends of the rods 34 by screws 48 set within tapped holes 50 at the ends of the rods 34. A corresponding construction is utilized for the overpass 44. A bar 46 passes over the septum 36, the ends of the bar 46 resting on top of the ends of the rods 34 of the line 26 and being secured thereto by screws 48 set within tapped holes 50 at the end of the rods 34.

To minimize reflections of microwave energy in both the underpass 43 and the overpass 44, the ends of the rods 34 are mitered. There is a miter 52 at the site of each hole 50 in both the underpass 43 and the overpass 44. The hole 50 may be dead-ended, or may open into the miters 52, as is convenient for the machining operations. The presence of the holes 50 have no more than a negligible effect on the impedance and reflection coefficients as their diameters are much smaller than a wavelength of the radiant energy.

As an example, in the construction of the microwave circuits 20 and the crossover 22, a 50 ohm line is utilized. To provide the 50 ohm impedance, the transmission lines 25–26 are fabricated with a cross-sectional configuration wherein the outer conductors of the lines 25–26 are of square cross section, and the cross section of each of the rods 34 is also of square shape. At a microwave frequency of 4 GHz (Gigahertz), the spacing between the opposite walls of the outer conductor in each line 25–26 is approximately 0.5 inches. The thickness of each rod 34 is approximately 0.2 inches. The rods 34 are centered between the outer walls of the lines 25–26.

With respect to the crossover 22, the impedance of the underpass 43 and the impedance of the overpass 44 are also equal to 50 ohms. Each of the bars 46 are equidistant between the septum 36 and the corresponding outer walls of the lines 25–26. In the underpass 43, the spacing between the lower surface of the bar 46 and the bottom wall of the outer conductor of the line 25 is slightly more than one-half the spacing between the bottom surface of a rod 34 and the bottom wall of the outer conductor of the transmission line 25. The thickness of the septum 36 is approximately 0.025 inches.

The foregoing dimensions provide for the 50 ohm impedance in the underpass 43, the overpass 44, as well as in the transmission lines 25–26. At the foregoing microwave frequency, a quarter-wavelength is approximately three-quarters of an inch.

The spacing between the miters 52 in either one of the lines 25–26 is to be an odd number of quarter-wavelengths so that reflections of radiant energy emanating from the discontinuities at each of the miters 52 tend to cancel along the lines 25–26 at a distance from the crossover 22. The size of the septum 36 measure approximately three-quarters of an inch. This size of septum is found to give adequate isolation, greater than approximately 36 dB (Decibels), between the waves of radiant energy propagating along the transmission lines 25–26.

For still greater isolation, the foregoing dimensions of the septum 36 can be increased. The reduction in reflection provided by the miters 52, and the cancellation of reflected waves resulting from the quarter-wavelength spacing of the miters 52, provide for attenuation of reflected waves of greater than 27 dB in the transmission lines 25–26. In accordance with the usual practice in the construction of microwave circuits, it is noted that the spacing between the miters 52 in either one of the lines 25–26 is only approximately one-quarter wavelength, the best spacing being determined experimentally. Adequate transmission characteristics have been found over a transmission band of 3700 MHz (Megahertz) to 6425 MHz.

With respect to the emplacement of the cover plate 32 upon the base plate 30, it is advantageous to provide grooves 54 with gaskets 56 of well-known commercially-available construction comprising a rubber impregnated with metallic particles. The gasket can be compressed in the grooves 54 upon a tightening of the cover plate 32 against the base plate 30. The gaskets provide a short circuit to microwave radiation at the interface between the cover plate 32 and the base plate 30 to prevent unwanted radiation of the microwave energy outside the microwave circuit 20.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A crossover for a microwave circuit comprising:

(a) a plate of electrically conductive material having channels therein for communication of microwave energy, the path of a first of said channels crossing the path of a second of said channels;

(b) a first and a second inner conducting means disposed respectively within said first and said second channels and electrically insulated from the walls of said channels;

(c) an electrically conductive septum disposed at the crossing of said paths;

(d) means within said first conducting means for depressing said first conducting means below said septum; and (e) means within said second conducting means for elevating said second conducting means above said septum to provide isolation in the conduction of microwave energy through said crossover along said first and said second conducting means.

2. A crossover according to claim 1 further comprising a cover of electrically conductive material disposed contiguous to said plate for closing said channels.

3. A crossover according to claim 2 wherein said elevating means includes a bar-shaped member of reduced thickness as compared to the balance of said second conducting means to provide a structure of a coaxial transmission line between said septum and said cover.

4. A crossover according to claim 1 wherein said depressing means comprises a bar-shaped conductor of reduced thickness as compared to the balance of said first conducting means for providing the structure of a coaxial transmission line between said septum and a bottom portion of said first channel.

5. A crossover according to claim 4 further comprising a cover structured in the form of a plate and disposed contiguous to said plate having the channels therein for closing off said first channel and said second channel for retaining microwave energy therein; and wherein said elevating means comprises a bar-shaped conductor of reduced thickness as compared to the balance of said second conducting means for providing the structure of a coaxial transmission line between said septum and said cover, said bar-shaped conductor of said depressing means being slung beneath the termini of said first inner conducting means located away from said septum, and said bar-shaped conductor of said elevating means being set upon termini of said second inner conducting means located away from said septum.

6. A crossover according to claim 5 wherein said first inner conducting means comprises a rod-shaped member of rectangular shape cross-section, and wherein said second inner conducting means comprises a rod-shaped member of rectangular shape cross-section, the termini of rod-shaped members in each of said conducting means being mitered at points of connection with the bar-shaped conductors of said depressing means and said elevating means.

7. A crossover according to claim 6 wherein said channels are of rectangular shape cross-section.

8. A crossover according to claim 7 wherein the rectangular cross-sectional shape of said channels and of said rod-shaped members are square to provide the configuration of a square-shaped coaxial transmission line.

9. A crossover according to claim 6 wherein the mitered portion of the respective inner conducting means are spaced apart by approximately one-quarter wavelength at the microwave frequency.

* * * * *